United States Patent [19]

Johnson

[11] 4,086,487

[45] Apr. 25, 1978

[54] COPLANAR DYNODE ELECTRON MULTIPLIER

[75] Inventor: Charles Bruce Johnson, Fort Wayne, Ind.

[73] Assignee: International Telephone and Telegraph Corporation, Nutley, N.J.

[21] Appl. No.: 728,493

[22] Filed: Sep. 30, 1976

[51] Int. Cl.[2] ..... H01J 39/12

[52] U.S. Cl. ..... 250/207; 250/213 VT; 313/103 R; 313/105 R; 330/42

[58] Field of Search ..... 250/207, 213 VT; 313/103 R, 104, 105 R; 330/42

[56] References Cited

U.S. PATENT DOCUMENTS

| | | | |
|---|---|---|---|
| 2,209,847 | 7/1940 | Rabuteau et al. | 313/105 |
| 2,231,676 | 2/1941 | Muller | 313/105 X |
| 2,700,116 | 1/1955 | Sherdon | 250/213 VT X |
| 2,836,760 | 5/1958 | Winter | 313/103 X |
| 3,235,765 | 2/1966 | Goodrich et al. | 313/103 CM X |

FOREIGN PATENT DOCUMENTS

| | | | |
|---|---|---|---|
| 210,266 | 1/1970 | U.S.S.R. | 313/103 |

*Primary Examiner*—James B. Mullins

*Attorney, Agent, or Firm*—John T. O'Halloran; Alfred C. Hill

[57] ABSTRACT

A dynode assembly having a given length and a field electrode assembly having the same given length are disposed in a vacuum envelope. The dynode assembly is in a first plane parallel to and spaced from the longitudinal axis of the envelope and the field electrode assembly is disposed in a second plane parallel to and spaced from the axis in a direction opposite to the spacing of the dynode assembly. The dynode assembly receives on its input end input electrons produced by an input signal which may be either electrical or optical. The field electrode assembly is shifted along the axis with respect to the dynode assembly such that the output end of the field electrode assembly extends beyond the output end of the dynode assembly such that lines of equal potential between the two assemblies form an angle $\theta$ with the first and second planes. A first operating voltage is coupled to both assemblies adjacent the input end thereof and a second operating voltage is coupled to both assemblies adjacent the output ends thereof. The second operating voltage has a value which is greater and more positive than the value of the first operating voltage. A bias voltage electrode having a bias voltage coupled thereto is disposed in the envelope adjacent the input end of both of the assemblies at an angle $\theta$ with respect to the first and second planes to ensure that all of the electrons are directed between the two assemblies. A collector electrode having an accelerating voltage coupled thereto is disposed in the envelope adjacent the output end of both assemblies at an angle $\theta$ with respect to the first and second planes. The collector electrode provides a multiplied output current for the multiplier.

38 Claims, 8 Drawing Figures

COPLANAR DYNODE ELECTRON MULTIPLIER

BACKGROUND OF THE INVENTION

This invention relates to electron multipliers and more particularly to dynode electron multipliers.

SUMMARY OF THE INVENTION

An object of the present invention is to provide an improved dynode electron multiplier.

Another object of the present invention is to provide a coplanar dynode electron multiplier.

A feature of the present invention is the provision of a coplanar dynode electron multiplier comprising: a dynode assembly having a given length disposed in a first plane, the dynode assembly having an input end and an output end, the dynode assembly receiving input electrons adjacent the input end thereof; a field electrode assembly having the given length disposed in a second plane spaced from and parallel to the first plane, the field electrode assembly having an input end adjacent the input end of the dynode assembly and an output end adjacent the output end of the field electrode assembly, the field electrode assembly being shifted with respect to the dynode assembly such that the output end of the field electrode assembly extends beyond the output end of the dynode assembly a given amount; a first operating voltage coupled to both the dynode assembly and the field electrode assembly adjacent the input end of both of the assemblies, the first operating voltage having a first given value; and a second operating voltage coupled to both the dynode assembly and the field electrode assembly adjacent the output end of both of the assemblies, the second operating voltage having a second given value greater and more positive than the first given value.

Another feature of the present invention is the provision of a coplanar dynode electron multiplier comprising: a vacuum envelope having a longitudinal axis; a dynode assembly having a given length disposed in the envelope in a first plane disposed parallel to and in a transverse spaced relation in one direction from the axis, the dynode assembly having an input end and an output end, the dynode assembly receiving input electrons adjacent the input end thereof, the input electrons having an input current with a magnitude directly proportional to the magnitude of an input signal; a field electrode assembly having the given length disposed in the envelope in a second plane disposed parallel to and in a transverse spaced relation in the other direction from the axis, the field electrode assembly having an input end adjacent the input end of the dynode assembly and an output end adjacent the output end of the field electrode assembly, the field electrode assembly being shifted along the axis with respect to the dynode assembly such that the output end of the field electrode assembly extends beyond the output end of the dynode assembly a given amount; a first operating voltage coupled to both the dynode assembly and field electrode assembly adjacent the input end of both of the assemblies; a second operating voltage coupled to both the dynode assembly and the field electrode assembly adjacent the output end of both of the assemblies, the second operating voltage having a second given value greater and more positive than the first given value; a bias voltage electrode having a bias voltage coupled thereto disposed in the envelope adjacent the input end of both of the assemblies at a given angle with respect to the first and second planes; and a collector electrode having an accelerating voltage coupled thereto disposed in the envelope adjacent the output end of both of the assemblies at the given angle with respect to the first and second planes, the collector electrode providing a multiplied output current for the multiplier, the output current being directly proportional to an amplified version of the input signal.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
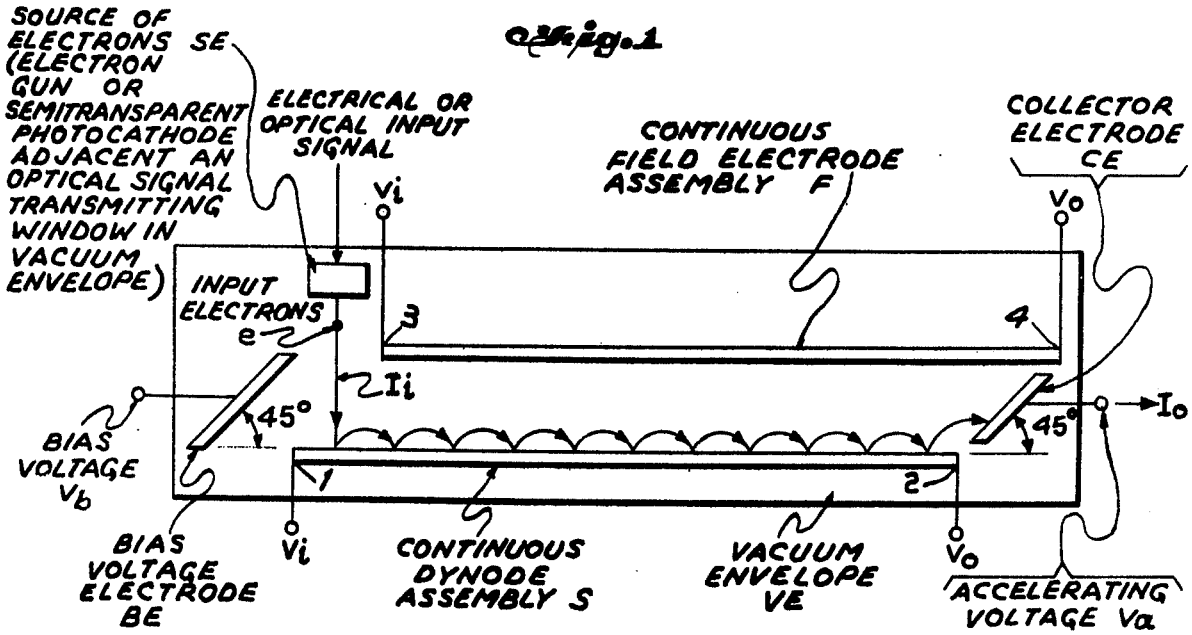
FIG. 1 is a diagrammatic illustration of a first embodiment of a coplanar dynode electron multiplier in accordance with the principles of the present invention.
Figure 8:
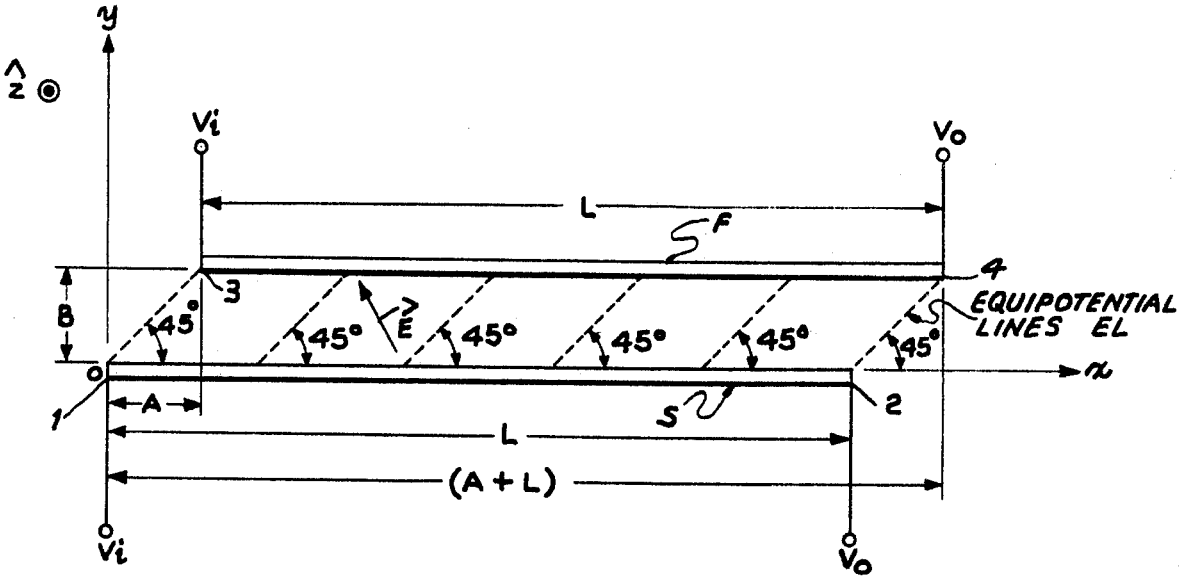
FIG. 8 is a diagrammatic illustration of the electron field within the active or field electrode-dynode assembly region of a coplanar dynode electron multiplier in accordance with the principles of the present invention.

Referring to FIG. 1, there is illustrated a diagrammatic view of a first embodiment of a coplanar dynode electron multiplier in accordance with the principles of the present invention. As illustrated, the coplanar dynode electron multiplier includes a vacuum envelope VE having a longitudinal axis, a continuous dynode assembly S having a given length L and a continuous field electrode assembly F having the given length L as shown in FIG. 8. The assembly S is disposed within envelope VE in a first plane disposed parallel to and in a transverse spaced relation in one direction from the longitudinal axis. The dynode assembly S has an input end 1 and an output end 2 with the dynode assembly S receiving input electrons *e* from a source of electrons SE adjacent to input end 1. The input electrons *e* have an input current $I_i$ with the magnitude thereof being directly proportional to the magnitude of an input signal. The assembly F is disposed within envelope VE in a second plane disposed parallel to and in a transverse spaced relation in the other direction from the axis of the envelope. Field electrode assembly F has an input end 3 and an output end 4 with the input end 3 being adjacent the input end 1 of assembly S and the output end 4 being adjacent the output end 2 of assembly S.

Assembly F is shifted along the axis with respect to assembly S such that the output end 4 of assembly F extends beyond the output end 2 of assembly S such that equal potential lines EL as shown in FIG. 8 make an angle $\theta$ with respect to assemblies F and S. Typically, this angle $\theta$ will be in the range from 45° to nearly 90°. For simplicity $\theta = 45°$ is used in each of the Figures in this disclosure. A first or input operating voltage $V_i$ is coupled to input ends 1 and 3 of assemblies S and F, respectively, and a second or output operating voltage is coupled to the output ends 2 and 4 of assemblies S and F, respectively. The second operating voltage has a value greater and more positive than the first operating voltage. The gain of the electron multiplier of the present invention is proportional to a voltage $V' = V_o - V_i$. A bias voltage electrode BE having a bias voltage $V_b$ coupled thereto is disposed in envelope VE adjacent the input ends 1 and 3 at an angle $\theta$ with respect to assemblies S and F. A collector electrode CE having an accelerating voltage $V_a$ coupled thereto is disposed in envelope VE adjacent output ends 2 and 4 at an angle $\theta$ with respect to the assemblies S and F. Collector electrode CE provides a multiplied output current $I_o$ for the coplanar dynode electron multiplier which is directly proportional to an amplified version of the input signal providing the input electrons *e*.

The continuous field electrode assembly F can be made from semiconducting material, such as silicon, germanium and the like, while the continuous dynode assembly S can be made from a compound of a semiconducting material and secondary electron emitting material, such as chemically (hot hydrogen) reducing Corning #8161 lead glass. The input electrons *e* upon striking assembly S cause secondary emission electrons to be emitted from the dynode assembly S with each successive impingement upon assembly S producing an increasing number of secondary emission electrons which eventually are collected at collector electrode CE to provide the desired output current $I_o$.

The purpose of electrode BE and its associated bias voltage $V_b$ is to ensure that the input electrons *e* and the resultant secondary emission electrons are forced into the region between assemblies F and S to perform the desired electron multiplication. Collector electrode CE with its applied accelerating voltage $V_a$ is provided for the purpose of collecting all the resulting secondary emission electrons produced by assembly S to provide the desired multiplied output current $I_o$ for the multiplier of the present invention.

The input electrons *e* are produced by a source of electrons SE disposed within envelope VE and may take the form of a conventional electron gun, or a semitransparent photocathode adjacent an optical signal transmitting window in the vacuum envelope VE. When an electron gun is employed for source SE, the input signal would be an electrical input signal and the resulting input current $I_i$ would be directly proportional to the magnitude of the electrical input signal. When source SE is a semitransparent photocathode adjacent an optical signal transmitting window in the vacuum envelope VE, the input signal would be optical and again the resulting input current $I_i$ would be directly proportional to the magnitude of the optical input signal.

Figure 2:
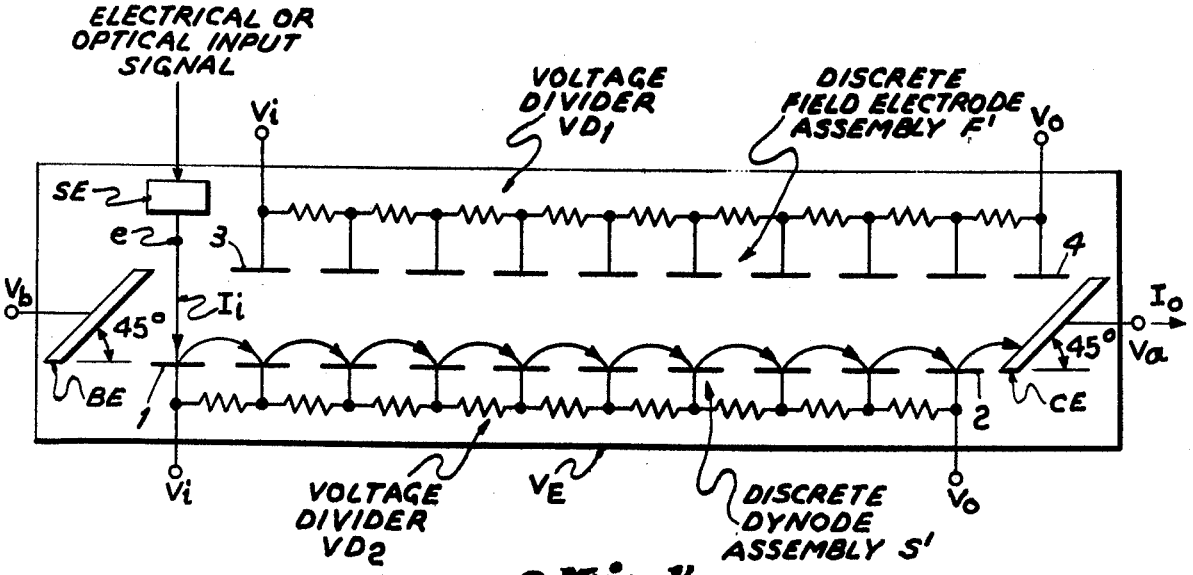
FIG. 2 is a diagrammatic illustration of a second embodiment of a coplanar dynode electron multiplier in accordance with the principles of the present invention.

Referring to FIG. 2, the coplanar dynode electron multiplier diagrammatically illustrated is substantially identical structurally and operatively to the embodiment of FIG. 1 with the exception that the field electrode assembly is a discrete field electrode assembly F' including a plurality of discrete field electrodes and that the dynode assembly is a discrete dynode assembly S' including a plurality of discrete dynodes. In addition a voltage divider $VD_1$ is coupled between the input operating voltage $V_i$ and the output operating potential $V_o$ and to each of the plurality of discrete field electrodes of assembly F' so that each of the plurality of discrete field electrodes have a field electrode operating voltage applied thereto such that each of the plurality of discrete field electrodes from input end 3 to output end 4 have an operating voltage increasing in value successively from the value of $V_i$ to the value of $V_o$. A similar voltage divider $VD_2$ is provided for the discrete dynode assembly S'. The increase in voltage from one electrode to the next adjacent electrode causes the secondary electrons to move along the axis of the envelope VE from the input end thereof to the collector electrode CE. It should be noted that the voltage dividers $VD_1$ and $VD_2$ are disposed within the envelope VE.

The field electrodes of assembly F' are composed of a conducting material, such as nickel, stainless steel or the like and the dynodes of assembly S' are composed of secondary emission electrode material, such as compounds of copperberyllium, silver-magnesium and the like.

Figure 3:
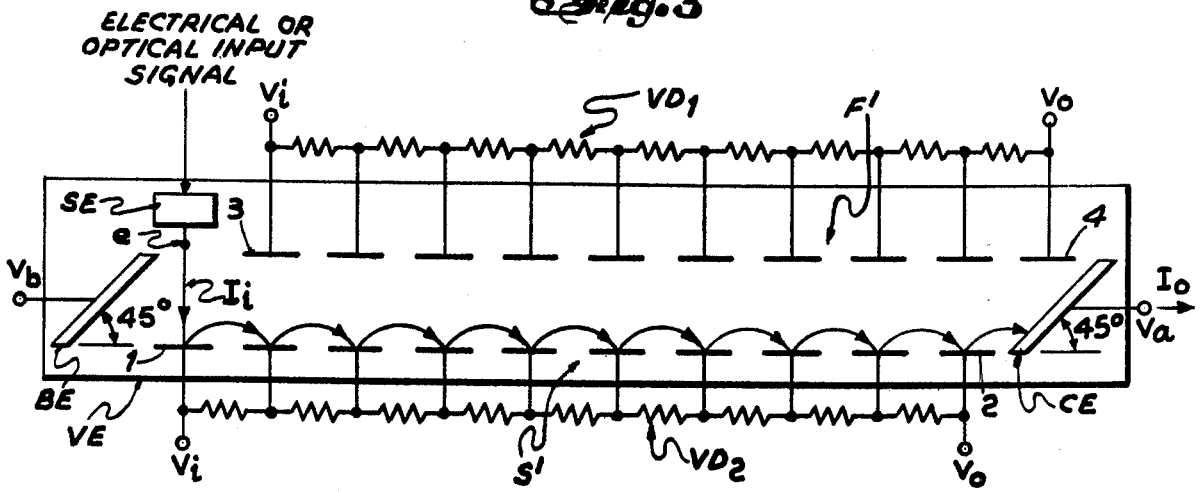
FIG. 3 is a diagrammatic illustration of a third embodiment of a coplanar dynode electron multiplier in accordance with the principles of the present invention.

Referring to FIG. 3, the coplanar dynode electron multiplier is identical to the coplanar dynode electron multiplier of FIG. 2 with the exception that the voltage dividers $VD_1$ and $VD_2$ are external of the vacuum envelope VE.

Figure 4:
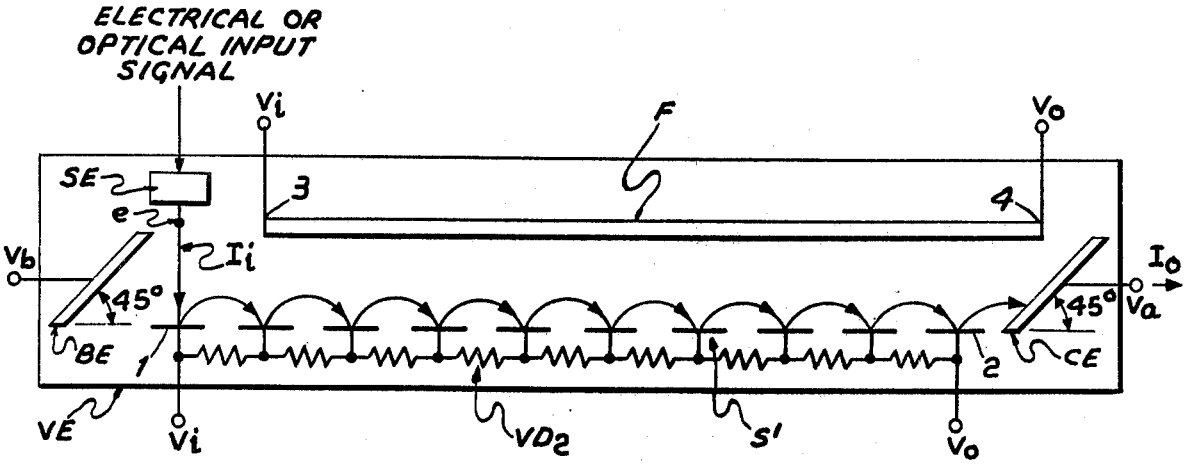
FIG. 4 is a diagrammatic illustration of a fourth embodiment of a coplanar dynode electron multiplier in accordance with the principles of the present invention.

Referring to FIG. 4, there is diagrammatically illustrated therein a coplanar dynode electron multiplier combining the features of the multiplier of FIG. 1 and the features of the multiplier of FIG. 2. In the multiplier of FIG. 4 the field electrode assembly F is a continuous field electrode, while the dynode assembly is a discrete dynode assembly S' with its associated voltage divider $VD_2$.

Figure 5:
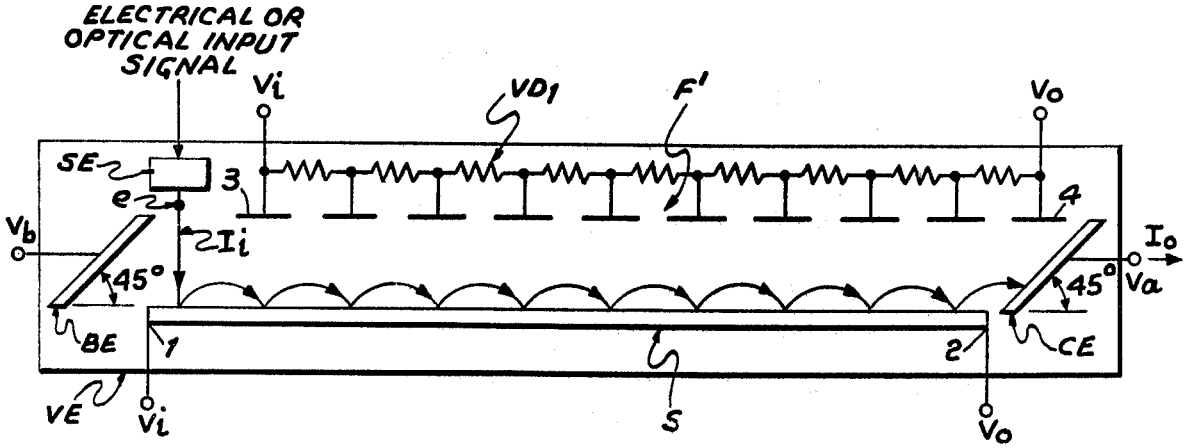
FIG. 5 is a diagrammatic illustration of a fifth embodiment of a coplanar dynode electron multiplier in accordance with the principles of the present invention.

Referring to FIG. 5, there is illustrated diagrammatically a coplanar dynode electron multiplier wherein the dynode assembly S is a continuous dynode assembly and the field electrode assembly is a discrete field electrode assembly F' with its associated voltage divider $VD_1$. The embodiments of FIGS. 4 and 5 are constructed and operate as described hereinabove with respect to FIGS. 1 and 2.

Figure 6:
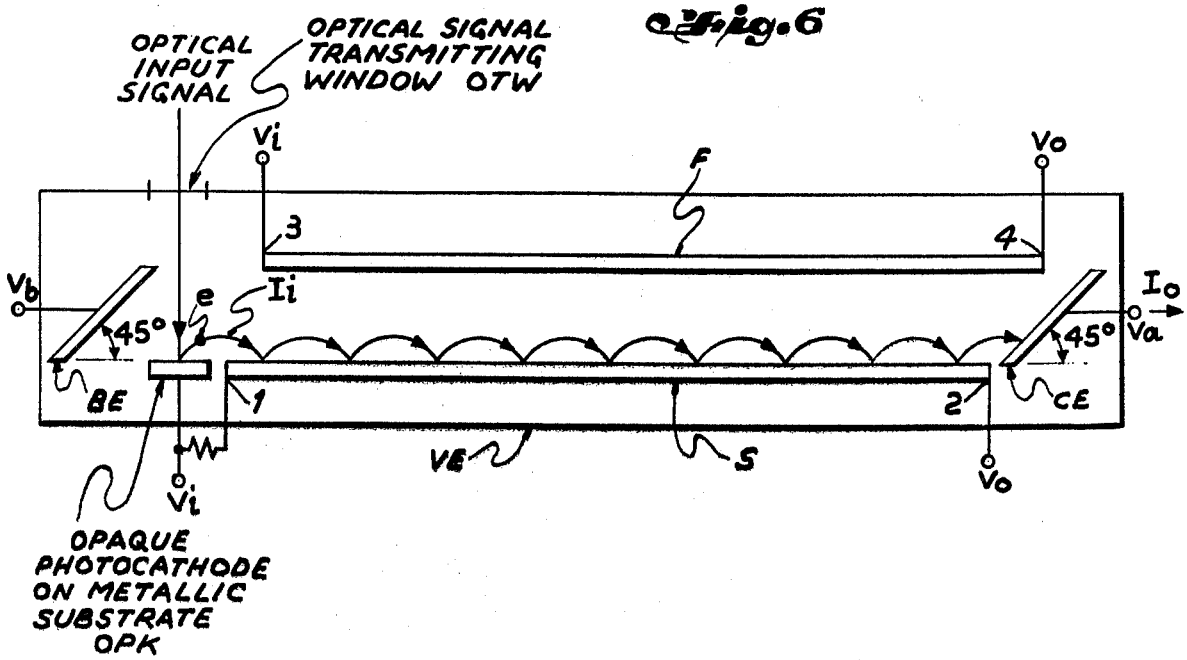
FIG. 6 is a diagrammatic illustration of a sixth embodiment of a coplanar dynode electron multiplier in accordance with the principles of the present invention.

Referring to FIG. 6, there is diagrammatically illustrated another embodiment of a coplanar dynode electron multiplier in accordance with the principles of the present invention where the multiplier includes a continuous field electrode assembly F and a continuous dynode assembly S with the input electrons *e* having a current $I_i$, with the characteristics as described hereinabove with respect to FIG. 1, being produced by an optical input signal passing through an optical signal transmitting window OTW in envelope VE to strike an opaque photocathode OPK which may be disposed on a metallic substrate. With the exception of the modification of the source of the input electrons *e*, the coplanar dynode electron multiplier in FIG. 6 is constructed and operates in the same manner as in the previous embodiments described.

Figure 7:
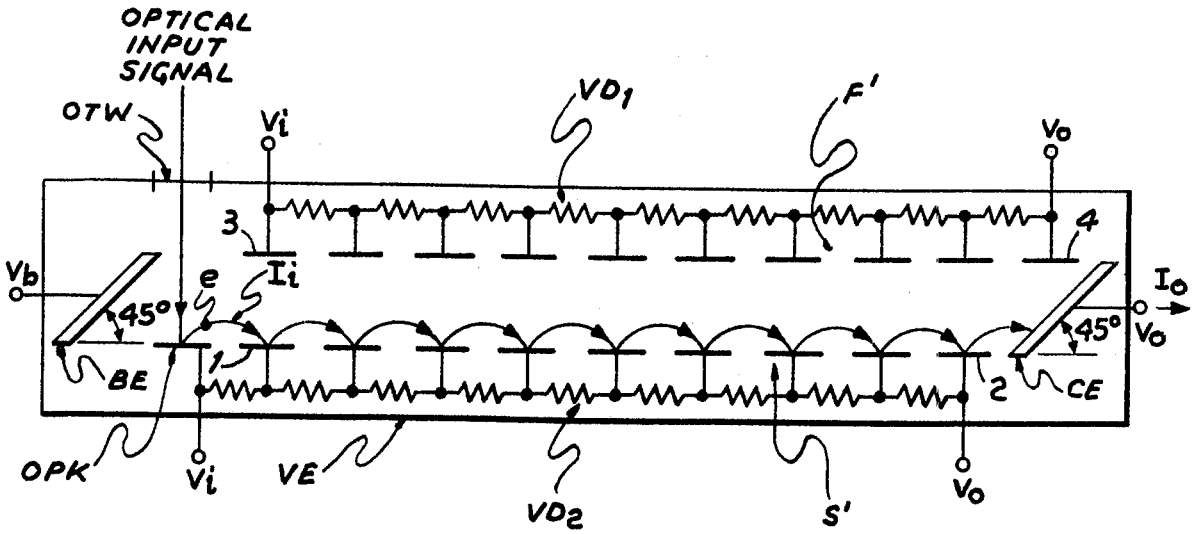
FIG. 7 is a diagrammatic illustration of a seventh embodiment of a coplanar dynode electron multiplier in accordance with the principles of the present invention.

Referring to FIG. 7, there is diagrammatically illustrated therein an embodiment of the coplanar dynode electron multiplier of the present invention similar to that of FIG. 6 with the exception that the field electrode assembly is a discrete field electrode assembly F' with its associated voltage divider $VD_1$ and the dynode assembly is a discrete dynode assembly S' with its associated voltage divider $VD_2$.

An oblique electric field $\vec{E}$ as illustrated in FIG. 8 is produced in the space between the assemblies S and F when equal electric field strengths exist in the planes of assemblies S and F, and when the electric field is produced by the embodiment shown in FIG. 1.

For the limiting case of two dimensional symmetry, i.e. the assemblies F and S extending infinitely in the $\pm\hat{z}$ directions, the expression for the electric field, as shown in FIG. 8, is $$\vec{E} = (-V'/L)(\hat{x} - A\hat{y}/B),$$

where $V' = (V_o - V_i)$ is the total voltage applied between the input ends 3 and 4 of assembly F and the input and output ends 1 and 2 of assembly S, L is the length of both assemblies S and F, $\hat{x}$, $\hat{y}$ and $\hat{z}$ are the cartesian coordinate unit vectors, and A and B and the $x$-axis and $y$-axis intercepts of the input end 3 of assembly F. Note that $E = |\vec{E}| = V'/(L \sin \theta)$, where $\theta = \tan^{-1}(B/A)$. The equations of motions for electrons in the space between assemblies S and F are, as a function of time ($t$), found to be $$\ddot{x}(t) = pV'/L,$$

$$\ddot{y}(t) = -pV'A/(LB),$$

$$\dot{x}(t) = \dot{x}_o + pV't/L,$$

$$\dot{y}(t) = \dot{y}_o - pV'At/(LB),$$

$$x(t) = x_o + \dot{x}_o t + pV't^2/(2L),$$

$$y(t) = y_o + \dot{y}_o t - pV'At^2/(2LB),$$

where $p$ is the electron charge/mass ratio, $\dot{x}_o$ and $\dot{y}_o$ are the initial electron velocities in the $\hat{x}$ and $\hat{y}$ directions, respectively, $x_o$ and $y_o$ are the coordinates of the secondary electron emission point, $\ddot{x}(t)$ is equal to $d^2x/dt^2$ (the second derivative of $x$ with respect to time), $\ddot{y}(t)$ is equal to $d^2y/dt^2$ (the second derivative of $y$ with respect to time), $\dot{x}(t)$ is equal to $dx/dt$ (the first derivative of $x$ with respect to time) and $\dot{y}(t)$ is equal to $dy/dt$ (the first derivative of $y$ with respect to time).

The electron time-of-flight T and landing energy, given the initial conditions, can be found using the above equations. For example, assume that $x_o = y_o = \dot{x}_o = o$. For this case, T is found to be $$T = 2LB\dot{y}_o/(pV'A)$$

so that if $L = 100$ mm (millimeters), $5A = B$, or $\theta = 79°$, $\dot{y}_o = 6 \times 10^5$ m/s (meters per second) and $V' = 1$ kV (kilovolts), the time-of-flight is $T = 2 \times 0.1 \times 6 \times 10^5/(2 \times 10^{11} \times 10^3) = 3$ *ns* (nanosecond), and the landing position is $x(T) = 2LB^2\dot{y}_o^2/(pV'A^2) = 2 \times 0.1 \times 5^2 \times (6 \times 10^5)/(2 \times 10^{11} \times 10^3) = 10$ mm and $y(T) = 0$. The corresponding landing energy is approximately $10 \times 10^3/100 = 100\ eV$ (electron volts) which is sufficiently high to produce a useful secondary electron emission yield. Note that these assumptions yield an electron multiplier having about ten "effective" dynode stages. Thus, by proper choice of the ratio A/B, the applied potential V' and the lengths of assemblies S and F, the coplanar dynode electron amplifier of the present invention will have practical usefulness.

The general type of structure disclosed therein can also be used as a so-called "ion-multiplier" or "ion-detector".

While I have described above the principles of my invention in connection with specific apparatus it is to be clearly understood that this description is made only by way of example and not as a limitation to the scope of my invention as set forth in the objects thereof and in the accompanying claims.

I claim:

1. A coplanar dynode electron multiplier comprising:

a vacuum envelope having a longitudinal axis;

a dynode assembly having a given length disposed in said envelope in a first plane disposed parallel to and in a transverse spaced relation in one direction from said axis, said dynode assembly having an input end and an output end, said dynode assembly receiving input electrons adjacent said input end thereof, said input electrons having an input current with a magnitude directly proportional to the magnitude of an input signal;

a field electrode assembly having said given length disposed in said envelope in a second plane disposed parallel to and in a transverse spaced relation in the other direction from said axis, said field electrode assembly having an input end adjacent said input end of said dynode assembly and an output end adjacent said output end of said field electrode assembly, said field electrode assembly being shifted along said axis with respect to said dynode assembly such that said output end of said field electrode assembly extends beyond said output end of said dynode assembly a given amount;

a first operating voltage coupled to both said dynode assembly and field electrode assembly adjacent said input end of both of said assemblies;

a second operating voltage coupled to both said dynode assembly and said field electrode assembly adjacent said output end of both of said assemblies, said second operating voltage having a second given value greater and more positive than said first given value;

a bias voltage electrode having a bias voltage coupled thereto disposed in said envelope spaced longitudinally from said input end of both of said assemblies at a given angle with respect to said first and second planes; and a collector electrode having an accelerating voltage coupled thereto disposed in said envelope adjacent said output end of both of said assemblies at said given angle with respect to said first and second planes, said collector electrode providing a multiplied output current for said multiplier, said output current being directly proportional to an amplified version of said input signal.

2. A multiplier according to claim 1, wherein the shift of said field electrode assembly with respect to said dynode assembly is such that equipotential lines between said field electrode assembly and said dynode assembly are at an angle of 45° with respect to said first and second planes.

3. A multiplier according to claim 2, further including an electron gun disposed in said envelope responsive to an electrical signal input to produce said input electron.

4. A multiplier according to claim 3, wherein said field electrode assembly includes a continuous electrode between said input end and said output end of said field electrode assembly.

5. A multiplier according to claim 4, wherein said dynode assembly includes a continuous dynode between said input end and said output end of said dynode assembly.

6. A multiplier according to claim 4, wherein said dynode assembly includes a plurality of discrete dynodes between said input end and said output end of said dynode assembly, and a voltage divider coupled between said first and second operating voltages and to each of said plurality of discrete dynodes to apply a dynode operating voltage to each of said plurality of discrete dynodes, said dynode operating voltages applied to each of said plurality of discrete dynodes from said input end to said output end of said dynode assembly increasing in value successively from said first given value to said second given value.

7. A multiplier according to claim 6, wherein said voltage divider is disposed externally of said envelope.

8. A multiplier according to claim 6, wherein said voltage divider is disposed internally of said envelope.

9. A multiplier according to claim 3, wherein said field electrode assembly includes a plurality of discrete field electrodes between said input end and said output end of said field electrode assembly, and a first voltage divider coupled between said first and second operating voltages and to each of said plurality of discrete field electrodes to apply a field electrode operating voltage to each of said plurality of discrete field electrodes, said field electrode operating voltages applied to each of said plurality of discrete field electrodes from said input end to said output end of said field electrode assembly increasing in value successively from said first given value to said second given value.

10. A multiplier according to claim 9, wherein said first voltage divider is disposed externally of said envelope.

11. A multiplier according to claim 9, wherein said first voltage divider is disposed internally of said envelope.

12. A multiplier according to claim 9, wherein said dynode assembly includes a continuous dynode between said input end and said output end of said dynode assembly.

13. A multiplier according to claim 9, wherein said dynode assembly includes a plurality of discrete dynodes between said input and said output end of said dynode assemby, and a second voltage divider coupled between said first and second operating voltages and to each of said plurality of discrete dynodes to apply a dynode operating voltage to each of said plurality of dynodes, said dynode operating voltage applied to each of said plurality of discrete dynodes from said input end to said output end of said dynode increasing in value successively from said first given value to said second given value.

14. A multiplier according to claim 13, wherein said second voltage divider is disposed externally of said envelope.

15. A multiplier according to claim 13, wherein said second voltage divider is disposed internally of said envelope.

16. A multiplier according to claim 2, further including an optical signal transmitting window disposed in said envelope adjacent said input end of said dynode assembly; and a semitransparent photocathode disposed adjacent said window to produce said input electrons in response to an optical input signal.

17. A multiplier according to claim 16, wherein said field electrode assembly includes a continuous electrode between said input end and said output end of said field electrode assembly.

18. A multiplier according to claim 17, wherein said dynode assembly includes a continuous dynode between said input end and said output end of said dynode assembly.

19. A multiplier according to claim 17, wherein said dynode assembly includes a plurality of discrete dynodes between said input end and said output end of said dynode assembly, and a voltage divider coupled between said first and second operating voltages and to each of said plurality of discrete dynodes to apply a dynode operating voltage to each of said plurality of discrete dynodes, said dynode operating voltages applied to each of said plurality of discrete dynodes from said input end to said output end of said dynode assembly increasing in value successively from said first given value to said second given value.

20. A multiplier according to claim 19, wherein said voltage divider is disposed externally of said envelope.

21. A multiplier according to claim 19, wherein said voltage divider is disposed internally of said envelope.

22. A multiplier according to claim 16, wherein said field electrode assembly includes a plurality of discrete field electrodes between said input end and said output end of said field electrode assembly, and a first voltage divider coupled between said first and second operating voltages and to each of said plurality of discrete field electrodes to apply a field electrode operating voltage to each of said plurality of discrete field electrodes, said field electrode operating voltages applied to each of said plurality of discrete field electrodes from said input end to said output end of said field electrode assembly increasing in value successively from said first given value to said second given value.

23. A multiplier according to claim 22, wherein said first voltage divider is disposed externally of said envelope.

24. A multiplier according to claim 22, wherein said first voltage divider is disposed internally of said envelope.

25. A multiplier according to claim 22, wherein said dynode assembly includes a continuous dynode between said input end and said output end of said dynode assembly.

26. A multiplier according to claim 22, wherein said dynode assembly includes
a plurality of discrete dynodes between said input and said output end of said dynode assembly, and
a second voltage divider coupled between said first and second operating voltages and to each of said plurality of discrete dynodes to apply a dynode operating voltage to each of said plurality of dynodes, said dynode operating voltage applied to each of said plurality of discrete dynodes from said input end to said output end of said dynode increasing in value successively from said first given value to said second given value.

27. A multiplier according to claim 26, wherein said second voltage divider is disposed externally of said envelope.

28. A multiplier according to claim 26, wherein said second voltage divider is disposed internally of said envelope.

29. A multiplier according to claim 2, further including
an optical signal transmitting window disposed in said envelope adjacent said input end of said dynode assembly; and
an opaque photocathode disposed in said first plane adjacent said input end of said dynode assembly and in communication with said window to produce said input electrons in response to an optical input signal.

30. A multiplier according to claim 29, wherein said field electrode assembly includes
a continuous electrode between said input end and said output end of said field electrode assembly.

31. A multiplier according to claim 30, wherein said dynode assembly includes
a continuous dynode between said input end and said output end of said dynode assembly.

32. A multiplier according to claim 29, wherein said dynode assembly includes
a continuous dynode between said input end and said output end of said dynode assembly.

33. A multiplier according to claim 29, wherein said field electrode assembly includes
a plurality of discrete field electrodes between said input end and said output end of said field electrode assembly, and
a first voltage divider coupled between said first and second operating voltages and to each of said plurality of discrete field electrodes to apply a field electrode operating voltage to each of said plurality of discrete field electrodes, said field electrode operating voltages applied to each of said plurality of discrete field electrodes from said input end to said output end of said field electrode assembly increasing in value successively from said first given value to said second given value.

34. A multiplier according to claim 33, wherein said first voltage divider is disposed internally of said envelope.

35. A multiplier according to claim 33, wherein said dynode assembly includes
a plurality of discrete dynodes between said input and said output end of said dynode assembly, and
a second voltage divider coupled between said first and second operating voltages and to each of said plurality of discrete dynodes to apply a dynode operating voltage to each of said plurality of dynodes, said dynode operating voltage applied to each of said plurality of discrete dynodes from said input end to said output end of said dynode increasing in value successively from said first given value to said second given value.

36. A multiplier according to claim 35, wherein said second voltage divider is disposed internally of said envelope.

37. A multiplier according to claim 29, wherein said dynode assembly includes
a plurality of discrete dynodes between said input end and said output end of said dynode assembly, and
a voltage divider coupled between said first and second operating voltages and to each of said plurality of discrete dynodes to apply a dynode operating voltage to each of said plurality of discrete dynodes, said dynode operating voltages applied to each of said plurality of discrete dynodes from said input end to said output end of said dynode assembly increasing in value successively from said first given value to said second given value.

38. A multiplier according to claim 37, wherein said voltage divider is disposed internally of said envelope.

* * * * *